US005472208A

United States Patent [19]

Berry

[11] Patent Number: 5,472,208

[45] Date of Patent: Dec. 5, 1995

[54] CHECKER TYPE GAME UTILIZING INTERFITTING GAME PIECES

[76] Inventor: William J. Berry, 4876 Hereford Rd., Hereford, Ariz. 85615

[21] Appl. No.: 327,547

[22] Filed: Oct. 24, 1994

[51] Int. Cl.[6] ..... A63F 3/00

[52] U.S. Cl. ..... 273/260; 273/290

[58] Field of Search ..... 273/260, 261, 273/288, 290

[56] References Cited

U.S. PATENT DOCUMENTS 4,643,432 2/1987 Berry et al. ..... 273/260

*Primary Examiner*—William H. Grieb
*Attorney, Agent, or Firm*—Paul H. Gallagher

[57] ABSTRACT

A game board, similar to a checkerboard, includes 10 squares on edge, and two sets of playing pieces, including 10 in each set moved by opposing players on opposite sides of the board. The players move the pieces toward each other, and perform capturing steps. The playing pieces are rings and pegs, and in the capturing steps, the rings and pegs are interfitted to form a stack. The pieces are so shaped that they can be stacked to indeterminate heights, including as many as 20 in a single stack.

1 Claim, 1 Drawing Sheet

CHECKER TYPE GAME UTILIZING INTERFITTING GAME PIECES

CROSS REFERENCE

U.S. Pat. No. 4,643,432 issued Feb. 17, 1987 to myself and Michael H. McManigan.

BACKGROUND OF THE INVENTION

1. Field of the Invention

Game board having squares thereon, and game pieces held by opposing players. Each player attempts to capture the opponents pieces, and when they are captured, the captive status is apparent.

2. Description of the Prior Art

The only known prior art is the above noted patent. In that patent, the game is of the same general kind, but is more limited in scope than the game of the present invention.

SUMMARY OF THE INVENTION

The game of the present invention is generally similar to that of the prior patent noted, in that the game includes a board and pieces which opposing players move toward each other, but the present invention includes the following features and advantages:

1. The game includes more adaptable playing pieces, than in the prior patent.

2. The game involves a greater number of variations.

BRIEF DESCRIPTION OF THE INDIVIDUAL FIGURES OF THE DRAWINGS

DESCRIPTION OF PREFERRED EMBODIMENTS

Figure 1:
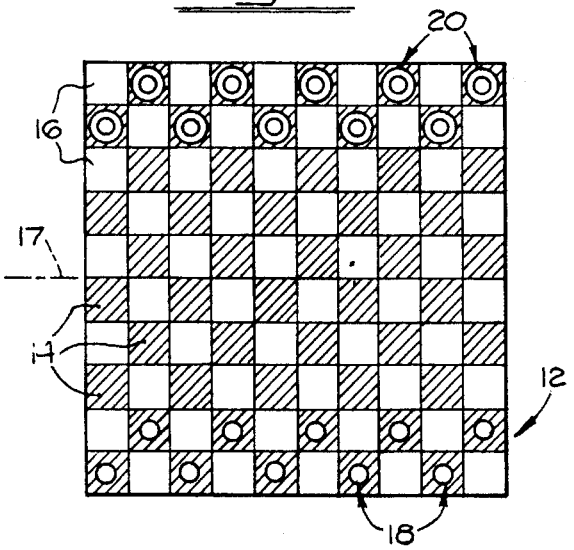
FIG. 1 is a plan view of the game board and the playing pieces thereon.

FIG. 1 Shows the game of the present invention, which is generally similar to that of my prior patent identified above. The game includes a board 12 similar to a checkerboard, in that it has alternate dark and light squares 14, 16, respectively, and it includes ten squares on edge.

The game also includes two sets of playing pieces 18, 20, respectively, those of each set being different from those of the other set as will be referred to hereinbelow.

There are hen playing pieces in each set, which may be referred to as pieces, or men, which are placed on respective squares, in a corresponding number of rows. The pieces may be placed on the dark squares for example, and thus the pieces occupy the two rows respectively adjacent the two players. Each player then moves his pieces toward the opposite side, to capture the opponent's pieces. The player seated at the lower side of the playing board (FIG. 1) is referred to as Player A, and the opponent as Player B.

Figure 2:
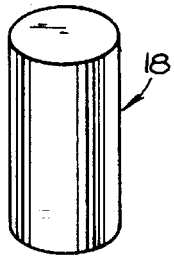
FIG. 2 is a perspective view of one of the two playing pieces.
Figure 3:
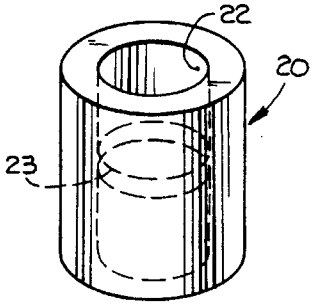
FIG. 3 is perspective view of the other playing piece.

FIG. 2 shows in perspective view, one of the playing pieces 18 cylindrical in shape, in the form of a peg or pin, and FIG. 3 is perspective view of one of the playing pieces 20, which is in the form an annulus, or ring, having a central hole 22.

Figure 5:
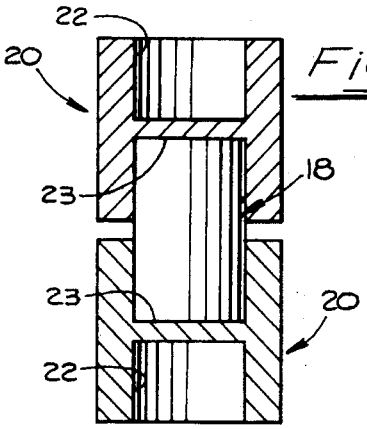
FIG. 5 is an axial view of the two opposed sets fitted together, partially in section.
Figure 6:
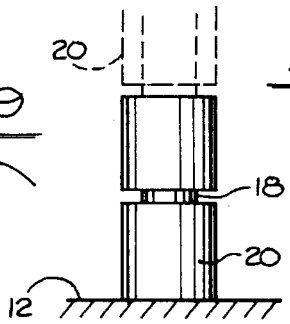
FIG. 6 shows multiple stacking.
Figure 7:
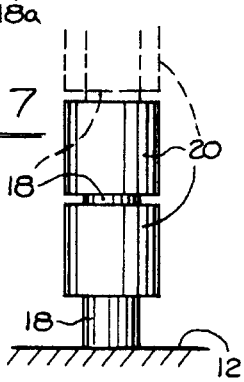
FIG. 7 is a view similar to FIG. 6 but with the bottom piece different from that of FIG. 6.
Figure 8:
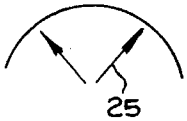
FIG. 8 is a diagrammatic illustration of one variation of game.
Figure 9:
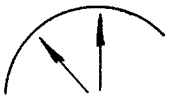
FIG. 9 is a view similar to FIG. 8 but illustrating another variation.
Figure 10:
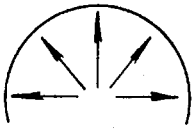
FIG. 10 is a view similar to FIG. 8 but illustrating another variation.
Figure 11:
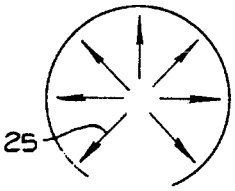
FIG. 11 is a view similar to FIG. 8 but illustrating another variation.
Figure 12:
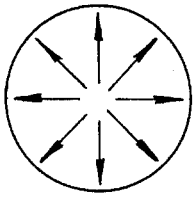
FIG. 12 is a view similar to FIG. 8 but illustrating another variation.

The pieces, (FIGS. 2, 3) in various phases of the game, are shown in FIGS. 5–7, those pieces fitted together being referred as a "playing piece unit" for convenience. In general, the pieces are dimensioned for free sliding relative to each other, in fitting them together, but are preferably dimensioned so that in their final position of interfitting, there is a slight friction fit holding them firmly together.

The playing pieces may be made of any suitable material, such as plastic, or other materials. In the playing of the game, the pieces 18, 20 are placed on the respective squares, as noted, on the playing board as illustrated in FIG. 1. Broadly stated, one of the principal features of the game is that the two pieces 18, 20 are interfitted to indicate a capturing step. The ring 20 is formed with an integral leaf 23 in the hole, midway of the latter, forming a positive stop for the peg. The peg 18 is inserted into the hole 22 of the ring, or, to be interpreted in another sense, the ring is fitted over the peg. In the capturing of an opposing piece, and the peg is fitted into the ring, or the ring fitted over the peg, the interfitted pieces then remain in stationary and stable position. The playing pieces 18, 20 may assume desired dimensions for the sake of appearance, and of stability, both when the pieces are standing alone, or in interfitted position. While the invention of course is not limited to any specific proportion and dimensions of the playing pieces, the following dimensions have proved practical: Both pieces 18, 20 are preferably of the same height or length, axially, such as for example as 1¼". The leaf 23 is ⅛" thick, and the diameters of the pieces, ¾" and 1¼" respectively.

Figure 4:
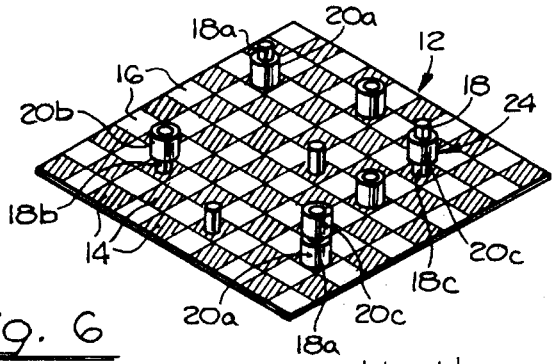
FIG. 4 is a perspective view of a playing board with certain of the playing pieces thereon, and with certain of them in different combinations fitted together and showing captor/captive status.

In playing the game, each player's pieces are moved toward the other's, alternately, one square at a time, and as the pieces approach each other, and are in squares next to each other, one player's piece may be moved into the square occupied by the opponent's piece, and establishes a captor/captive relationship. This is done by fitting the pieces together. Assuming that at this point it is the turn of Player A to move, he fits the peg 18 into the hole of Player B's ring 20, as at **18*a* in FIG. 4. This position indicates such capture, and the uppermost piece, or the peg 18*a*, is the captor piece, and the lower piece, or ring 20*a***, is the captive piece. These pieces, arranged in a vertical stack, are then handled as a unit and treated according to the specific rules of the particular game being played.

In a similar play in the opposite direction, i.e., Player B, in performing a capturing step, fits the ring **20*b* over the opposing peg 18*b*, and in this case also, the upper piece indicates the captor piece; thus the ring 20*b* is the captor piece and the peg 18*b*** the captive piece.

The rules of the game also provide for re-capturing. Where the peg 18 is the captor piece, as at 18*a* (FIG. 4) Player B can re-capture the stack. In doing this, he places a ring 20*c* over the peg 18*a* that was the previous captor piece, and recaptures the stack or unit, which of course results in re-capturing his own piece 20*a* that was lowermost. As a result of this re-capturing step, the ring 20*c* is the uppermost piece and it controls the stack.

A similar situation exists in the opposite direction of playing, and in this case attention is directed again to FIG. 4, where the lower piece, or peg 18*c*, is captured, Player A can, in proper circumstances re-capture, i.e., by placing a peg 18*d* in the ring 20*b*, now 20*c*, which was uppermost, resulting in a three-piece stack 24 where the peg 18*d* is again uppermost, and controls the stack.

The dimensions of the pieces, indicated above, provide stability to the pieces not only when resting alone, but also when interfitted in a column in any of the combinations referred to. The dimensions given above have been found satisfactory to maintain the stacks, or pieces in column, stable.

Additionally, the dimensions of the playing pieces, maintaining the desired proportions therebetween, may be in proportion to the dimensions of the game board itself, such for example as having the ring of less diameter than the edge of a square on the board.

Referring to FIG. 5, the pieces are dimensioned so that the pegs extend from a practical standpoint, into the hole a maximum amount, then being in engagement with the center leaf or partition 23. Thus the peg extends out of the hole a distance equal to 1/16" greater than one-half the length of the peg.

The game includes the feature of multiple stacking of the pieces, as shown in FIGS. 6 and 7. In this phase of the game, the pieces may be stacked interminably to the maximum number of pieces utilized in the game. In the example of the game given, there are ten pieces per player, and they can be captured and re-captured until all are in a single stack, that is, twenty in a single stack. The dimensions of the pieces, even the pegs 18, are such as to form such a stack that is stable. Also, the spacing between the rings 20 is such as to enable quick recognition of the stack and facilitate counting the pieces.

In playing the game, the pieces can be moved as indicated by the arrows 25 in FIGS. 8–12. The arrows respectively represent moves straight forward and back, laterally each way, and diagonally forward and back. Two forms or "games" are provided, each including ten variations, providing a total of 20 variations, each constituting a "game" in a broad or generic sense.

Reference is now made to the rules of play of certain specific forms of game, and to specific games to be played with the foregoing game device:

There are two games and ten ways to play each game.

Game #1

Variation #1:

Pieces move only on a diagonal, one space forward diagonally at a time. Capture takes place by stacking, one piece on the other. Pieces on captured space do not move. The points are added up at the end of the game.

Variation #2:

Pieces move straight forward or on a diagonal, forward only.

Variation #3:

Pieces move forward or left and right only.

Variation #4:

Pieces move diagonally or left and right only.

Variation #5:

Pieces move diagonally, left and right and forward.

Variation #6:

Pieces move diagonally only, both forward and backward.

Variation #7:

Pieces move straight and diagonally in both cases, both forward and backward.

Variation #8:

Pieces move forward and backward, left and right only.

Variation #9:

Pieces move diagonally both forward and backward and left and right.

Variation #10:

Pieces move diagonally both forward and backward and left and right and straight forward or backward.

End of Game #1

Game #2

Same playing pieces and piece placement as in Game #1.

Players can recapture by stacking to recapture square or reoccupy square.

Same piece movement as Game #1, all variations.

Total number of games; 2, with 10 variations in each.

Real total number of games: 20

Scoring is progressive.

First row toward player an opposer's side.

Score 1 point, 2nd row score 2 points, progressively to 10th row score 10 points.

EXAMPLE

If a Player A captures an opponents Player B, on square 4 from Player A and 6 rows from Player B, the score is A—4, B—0.

Player B is the captor on his or her row 6 and Player A is the captured as captive on his or her row 4 the score is B—6, A—0, etc.

I claim:

1. A game comprising, a game board of checkerboard type having an imperforate, planar upper playing surface, playing pieces including a set of pegs and a set of rings, adapted to be placed on the game board with the sets at respectively opposite sides of the board and in mutually opposed relation, the pieces in each set being moved across the game board toward the respective opposite side and thereby toward the pieces of the other set, in playing the game, all of the pieces of each set being identical, the rings and the pegs being of identical length in axial direction, the diameter of the pegs is greater than ½ the external diameter of the rings, the rings having central holes and a transverse thin leaf midway of the hole, the leaf being in thickness substantially 1/10 the length of the ring, the pegs being insertable into the holes an extent that equals ½ the length of the peg less ½ the thickness of the thin leaf, the rings and pegs thereby being interconnectible alternately to an extent corresponding to the results of the game being played, which can be as great as a plurality of identical pieces of each set, in a linear stack, in such a stack, the pegs being spaced axially from each other the thickness of the thin leaf, and the adjacent rings being spaced apart the same distance as the pegs, whereby when the end pieces of any stack are of the same set, the entire stack is only slightly longer than the same number of those end pieces as are in the stack, and whereby the stack is capable of being formed of a plurality of the pieces of each of the sets.

* * * * *